US011807432B2

(12) United States Patent
Weaver et al.

(10) Patent No.: US 11,807,432 B2
(45) Date of Patent: Nov. 7, 2023

(54) SHIPPING AND DISPENSING CONSTRUCT

(71) Applicant: Graphic Packaging International, LLC, Atlanta, GA (US)

(72) Inventors: Sharon Weaver, Chicago, IL (US); Ronald E. Hajek, Joliet, IL (US); Dana Exner, Wheaton, IL (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 17/354,475

(22) Filed: Jun. 22, 2021

(65) Prior Publication Data

US 2021/0403199 A1 Dec. 30, 2021

Related U.S. Application Data

(60) Provisional application No. 63/043,366, filed on Jun. 24, 2020.

(51) Int. Cl.
*B65D 5/54* (2006.01)
*B65D 5/72* (2006.01)

(52) U.S. Cl.
CPC ..... *B65D 5/725* (2013.01); *B65D 5/542* (2013.01); *B65D 5/5445* (2013.01)

(58) Field of Classification Search
CPC .. B65D 5/5475; B65D 5/5445; B65D 5/5495; B65D 77/003; B65D 2571/0066; B65D 2571/00327
USPC ..... 229/103.2, 120.01, 120.011
See application file for complete search history.

(56) References Cited

U.S. PATENT DOCUMENTS

| | | | |
|---|---|---|---|
| 396,570 | A | 1/1889 | Hotchkiss |
| 637,838 | A | 11/1899 | Vernon |
| 1,373,365 | A | 3/1921 | Smouse |
| 1,892,756 | A | 1/1933 | Van Home |
| 2,330,521 | A | 9/1943 | Scheide |

(Continued)

FOREIGN PATENT DOCUMENTS

| | | |
|---|---|---|
| CA | 1079240 | 6/1980 |
| EP | 0 060 504 B1 | 11/1984 |

(Continued)

OTHER PUBLICATIONS

Colpac Vizione Cardboard Food Tray. [online] Published on Apr. 20, 2017. Retrieved Dec. 18, 2018 from URL: http://www.castawayfoodpackaging.co.nz/product/01viztfl-vizione-cardboard-food-tray.

(Continued)

*Primary Examiner* — Nathan J Newhouse
*Assistant Examiner* — Phillip D Schmidt
(74) *Attorney, Agent, or Firm* — WOMBLE BOND DICKINSON (US) LLP

(57) ABSTRACT

A shipping and dispensing construct for engaging a plurality of product holding containers. The shipping and dispensing construct can comprise a plurality of panels comprising a front panel, a bottom panel, and a back panel. One or more panels of the plurality of panels is for being attached to attachment features of the respective product holding containers of the plurality of product holding containers. Dispensing features can be for removal of a respective product holding container from the shipping and dispensing construct. The dispensing features can be in one or more panels of the plurality of panels.

20 Claims, 6 Drawing Sheets

(56) References Cited

U.S. PATENT DOCUMENTS 2,341,762 A 2/1944 Conklin
2,355,729 A 8/1944 Inman
2,355,730 A 8/1944 Inman
2,359,986 A 10/1944 Grecco
2,662,684 A 12/1953 Robins
2,684,178 A 7/1954 Keeler
2,723,027 A 11/1955 Reynolds
2,811,250 A 10/1957 Arneson
2,872,036 A 2/1959 Forrer
2,888,132 A * 5/1959 Guyer ..... B65D 5/5445 206/820
3,027,063 A 3/1962 Zastrow
3,071,244 A * 1/1963 Doran ..... B65D 5/5495 206/45.29
3,144,190 A 8/1964 Holt
3,158,312 A 11/1964 Simkins
3,186,587 A 6/1965 Englander
3,263,807 A 8/1966 Fingerhut
3,315,875 A 4/1967 Rudolf
3,324,999 A 6/1967 Farquhar
3,355,089 A 11/1967 Champlin
3,375,968 A 4/1968 Weiss
3,392,878 A 7/1968 Jackson
3,447,735 A 6/1969 Whitney
D217,441 S 5/1970 Kanaga
3,756,502 A 9/1973 Swanson
3,840,171 A 10/1974 Waters
3,840,172 A 10/1974 Zimmermann
3,886,901 A 6/1975 Zeitter
3,949,928 A 4/1976 Perkins
4,068,795 A 1/1978 Forster
4,082,215 A 4/1978 Eichenauer
D250,093 S 10/1978 Schillinger
4,170,325 A 10/1979 Pawlowski
4,252,236 A 2/1981 Roccaforte
4,277,015 A 7/1981 Crane
D260,076 S 8/1981 Schillinger
4,328,923 A 5/1982 Graser
4,340,169 A 7/1982 Webinger
4,415,082 A * 11/1983 Martin ..... B65D 71/28 229/117.14
4,449,633 A 5/1984 Johnson et al.
4,794,005 A 12/1988 Swiontek
4,817,866 A 4/1989 Wonnacott
4,860,944 A 8/1989 Wonnacott
4,865,187 A 9/1989 Zulauf
4,905,837 A 3/1990 Schuster et al.
4,928,817 A 5/1990 Focke
4,944,405 A 7/1990 Buford
5,016,813 A 5/1991 Simons
5,020,663 A 6/1991 Dallas
5,044,503 A 9/1991 Wein
5,048,687 A 9/1991 Suzuki
D320,557 S 10/1991 Schuster
5,094,359 A 3/1992 DeMars et al.
5,125,565 A 6/1992 Rogers
5,170,934 A 12/1992 Lemoine
5,292,058 A 3/1994 Zoss et al.
5,294,044 A 3/1994 Clark
5,307,986 A 5/1994 Schuster
5,388,758 A 2/1995 Scovell
5,411,204 A 5/1995 Demay
5,520,284 A 5/1996 Gray
5,522,538 A 6/1996 Gray
5,590,813 A 1/1997 Abramczyk
5,675,960 A 10/1997 Weaver
5,871,090 A 2/1999 Doucette et al.
6,041,997 A 3/2000 Jensen
6,126,065 A 10/2000 Wee
6,155,412 A 12/2000 Le Bras
D458,127 S 6/2002 De Groote
D467,499 S 12/2002 Garza et al.
D473,787 S 4/2003 Jones, Jr. et al.
D478,737 S 8/2003 Sparkowski
D484,043 S 12/2003 Hwang et al.
D484,799 S 1/2004 Hoffman
6,676,010 B1 1/2004 Roseth et al.
D505,620 S 5/2005 Huebsch
6,938,818 B2 9/2005 Moorman
6,981,631 B2 1/2006 Fogle et al.
D515,942 S 2/2006 Hamblin
D519,366 S 4/2006 Epstein
7,021,525 B2 4/2006 Jouppi et al.
D519,830 S 5/2006 Yocum
7,234,593 B2 6/2007 Fath
D561,023 S 2/2008 Jacxsens
7,380,701 B2 6/2008 Fogle et al.
7,552,820 B2 6/2009 Kohler
7,669,755 B2 3/2010 Smalley
7,699,214 B2 4/2010 Mestre et al.
D622,589 S 8/2010 Elias
D630,508 S 1/2011 Hubbard, Jr.
D631,741 S 2/2011 Hubbard, Jr.
D631,742 S 2/2011 Hubbard, Jr.
D631,743 S 2/2011 Hubbard, Jr.
7,938,257 B2 5/2011 Kohler
8,028,839 B2 10/2011 Learn
D656,394 S 3/2012 Smith
D666,830 S 9/2012 Glenn
D684,858 S 6/2013 Sill
8,701,974 B2 4/2014 Davies
8,740,050 B2 6/2014 Zinck et al.
D717,162 S 11/2014 Baker
9,033,209 B2 5/2015 Fogle et al.
9,073,658 B2 7/2015 Spivey, Sr. et al.
9,162,793 B2 10/2015 Stewart
9,169,037 B2 10/2015 Pinkstone
9,211,971 B2 12/2015 Fogle et al.
9,248,933 B2 2/2016 Spivey, Sr. et al.
D753,994 S 4/2016 Pantelleria
9,309,023 B2 4/2016 Hubbard, Jr.
9,321,553 B1 4/2016 Spivey, Sr. et al.
D755,624 S 5/2016 Ng
9,346,234 B2 5/2016 Hajek et al.
D762,468 S 8/2016 Pantelleria et al.
D769,114 S 10/2016 Montemayor
9,505,516 B2 11/2016 Hubbard, Jr.
D775,947 S 1/2017 Epstein
9,701,438 B2 7/2017 Fitzwater et al.
D805,894 S 12/2017 Lee
9,845,182 B2 12/2017 Baldino
D810,561 S 2/2018 Garnett
D811,875 S 3/2018 Haen et al.
D813,029 S 3/2018 Borkovetz et al.
10,017,290 B2 7/2018 Faulkner et al.
10,086,972 B2 10/2018 Hajek
10,232,973 B2 3/2019 Burke
10,239,651 B2 3/2019 Exner et al.
D848,835 S 5/2019 Exner
D864,751 S 10/2019 Exner
D864,753 S 10/2019 Exner
D880,999 S 4/2020 Sill
D887,830 S 6/2020 Kirchen
D904,870 S 12/2020 Sill
D912,508 S 3/2021 Kirchen
D920,099 S 5/2021 Stabile
D923,473 S 6/2021 Jacobsson
11,203,460 B2 12/2021 Hokanson
D949,010 S 4/2022 Sill
2004/0031842 A1 2/2004 Westerman et al.
2004/0182916 A1 9/2004 Roseth
2004/0226988 A1 11/2004 Fogle
2004/0245327 A1 12/2004 Oliff
2005/0056554 A1* 3/2005 Fath ..... B65D 85/1072 206/242
2005/0092649 A1 5/2005 Ford
2005/0279815 A1 12/2005 Fogle et al.
2006/0255105 A1 11/2006 Sweet
2007/0095881 A1 5/2007 Manaige
2007/0295796 A1 12/2007 Sutherland
2008/0087679 A1 4/2008 Cook
2009/0039144 A1 2/2009 Hooi et al.
2011/0226847 A1 9/2011 Nakano
2012/2733871 11/2012 Ivosevic

(56) References Cited

U.S. PATENT DOCUMENTS

| | | | | |
|---|---|---|---|---|
| 2013/0112592 | A1* | 5/2013 | Bowers | B31B 50/142 206/774 |
| 2014/0096488 | A1 | 4/2014 | Gonzalez | |
| 2014/0263600 | A1 | 9/2014 | Valencia | |
| 2015/0083625 | A1 | 3/2015 | Paredes et al. | |
| 2016/0101917 | A1 | 4/2016 | Spivey, Sr. | |
| 2017/0267397 | A1 | 9/2017 | Cooper | |
| 2017/0297796 | A1 | 10/2017 | Ball | |
| 2020/0189818 | A1 | 6/2020 | McCree et al. | |
| 2020/0207055 | A1 | 7/2020 | Wirtz | |
| 2021/0309412 | A1 | 10/2021 | Abjean | |
| 2021/0403198 | A1 | 12/2021 | Hajek | |
| 2021/0403199 | A1 | 12/2021 | Weaver | |
| 2022/0017259 | A1 | 1/2022 | Barbieri | |

FOREIGN PATENT DOCUMENTS

| | | | | |
|---|---|---|---|---|
| EP | 0 647 199 | B1 | 5/2000 | |
| EP | 1 200 316 | B1 | 6/2004 | |
| EP | 2 008 937 | A1 | 12/2008 | |
| EP | 2 493 772 | B1 | 6/2014 | |
| GB | 2 387 591 | | 10/2003 | |
| JP | 3062562 | U | 10/1999 | |
| JP | 2004-123101 | | 4/2004 | |
| JP | 2009-073536 | | 4/2009 | |
| JP | 2011-093601 | A | 5/2011 | |
| KR | 20-0171748 | | 3/2000 | |
| KR | 20-0450117 | Y1 | 9/2010 | |
| WO | WO 89/10308 | | 11/1989 | |
| WO | WO 98/47417 | | 10/1998 | |
| WO | WO-0071427 | A1 * | 11/2000 | B65D 5/5495 |
| WO | WO 00/78619 | A2 | 12/2000 | |
| WO | WO-0078619 | A2 * | 12/2000 | B65D 5/5495 |
| WO | WO 2012/148986 | A1 | 11/2012 | |

OTHER PUBLICATIONS

International Search Report and Written Opinion for PCT/US2021/038431 dated Oct. 18, 2021.
International Search Report and Written Opinion for PCT/US2021/038435 dated Oct. 21, 2021.
International Search Report and Written Opinion for PCT/US2021/038438 dated Oct. 6, 2021.
International Search Report and Written Opinion for PCT/US2021/038427 dated Oct. 18, 2021.
International Search Report and Written Opinion for PCT/US2021/038434 dated Oct. 19, 2021.
U.S. Appl. No. 29/756,578, filed Oct. 29, 2020.
U.S. Appl. No. 29/756,579, filed Oct. 29, 2020.
U.S. Appl. No. 29/756,580, filed Oct. 29, 2020.
U.S. Appl. No. 29/756,581, filed Oct. 29, 2020.
U.S. Appl. No. 29/753,802, filed Oct. 2, 2020.
U.S. Appl. No. 17/354,468, filed Jun. 22, 2021.
U.S. Appl. No. 17/354,486, filed Jun. 22, 2021.
U.S. Appl. No. 17/354,491, filed Jun. 22, 2021.
U.S. Appl. No. 17/354,454, filed Jun. 22, 2021.

* cited by examiner

SHIPPING AND DISPENSING CONSTRUCT

CROSS-REFERENCE TO RELATED APPLICATIONS

This application claims the benefit of U.S. Provisional Patent Application No. 63/043,366, filed on Jun. 24, 2020.

INCORPORATION BY REFERENCE

The disclosures of U.S. Provisional Patent Application No. 63/043,366, which was filed on Jun. 24, 2020, and U.S. Design patent application No. 29/756,579, filed on Oct. 29, 2020, are hereby incorporated by reference for all purposes as if presented herein in their entirety.

BACKGROUND OF THE DISCLOSURE

The present disclosure generally relates to shipping and dispensing constructs and/or cartons for holding and dispensing containers or other types of articles. More specifically, the present disclosure relates to a shipping and dispensing construct for holding and dispensing a plurality of containers such as product holding containers, the shipping and dispensing construct having features to facilitate dispensing one or more of the product holding containers.

SUMMARY OF THE DISCLOSURE

In general, one aspect of the disclosure is directed to a shipping and dispensing construct for engaging a plurality of product holding containers. The shipping and dispensing construct can comprise a plurality of panels comprising a front panel, a bottom panel, and a back panel. One or more panels of the plurality of panels is for being attached to attachment features of the respective product holding containers of the plurality of product holding containers. Dispensing features can be for removal of a respective product holding container from the shipping and dispensing construct. The dispensing features can be in one or more panels of the plurality of panels.

In another aspect, the disclosure is generally directed to a construct blank for forming a shipping and dispensing construct for engaging a plurality of product holding containers. The construct blank can comprise a plurality of panels comprising a front panel, a bottom panel, and a back panel. One or more panels of the plurality of panels is for being attached to attachment features of the respective product holding containers of the plurality of product holding containers. Dispensing features can be for removal of a respective product holding container from the shipping and dispensing construct formed from the construct blank. The dispensing features can be in one or more panels of the plurality of panels.

In another aspect, the disclosure is generally directed to a package that can comprise a shipping and dispensing construct comprising a plurality of panels extending at least partially around an interior of the construct and dispensing features in one or more panels of the plurality of panels. the package further can comprise a plurality of product holding containers. Each product holding container of the plurality of product holding containers can comprise an attachment feature, and the product holding containers can be attached to the shipping and dispensing construct at the respective attachment features. The dispensing features can facilitate removing the product holding containers of the plurality of product holding containers from the package.

In another aspect, the disclosure is generally directed to a method that can comprise obtaining a construct blank comprising a plurality of panels comprising a front panel, a bottom panel, and a back panel and dispensing features in one or more panels of the plurality of panels. The method further can comprise obtaining a plurality of product holding containers. Each product holding container of the plurality of product holding containers can comprise an attachment feature. Also, the method can comprise attaching one or more panels of the plurality of panels to the attachment features of the plurality of product holding containers and forming the construct blank into a shipping and dispensing construct. The dispensing features can facilitate removing the product holding containers of the plurality of product holding containers from the shipping and dispensing construct.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to constructs, cartons, carriers, clips, sleeves, or the like, and packages for shipping and dispensing articles such as containers, cartons, constructs, sleeves, etc. that hold a product. The containers can be product holding containers used for packaging consumer products such as soap, but the product holding containers could hold other products such as food and beverage products, or any other suitable product. The product holding containers can be made from materials suitable in composition for packaging the particular consumer product or item, and the materials include, but are not limited to, paperboard, composite paperboard, and the like; plastics such as PET, LDPE, LLDPE, HDPE, PP, PS, PVC, EVOH, and Nylon, or any combination thereof, or any other suitable material.

Constructs according to the present disclosure can accommodate articles of any shape. For the purpose of illustration and not for the purpose of limiting the scope of the disclosure, the following detailed description describes product holding containers (e.g., paperboard cartons having closed ends such as cuboid paperboard boxes) as associated with the shipping and dispensing construct embodiments and/or as disposed within the construct embodiments. In this specification, the terms "inner," "interior," "outer," "exterior," "lower," "bottom," "upper," and "top" indicate orientations determined in relation to fully erected and upright constructs and cartons.

Figure 1:
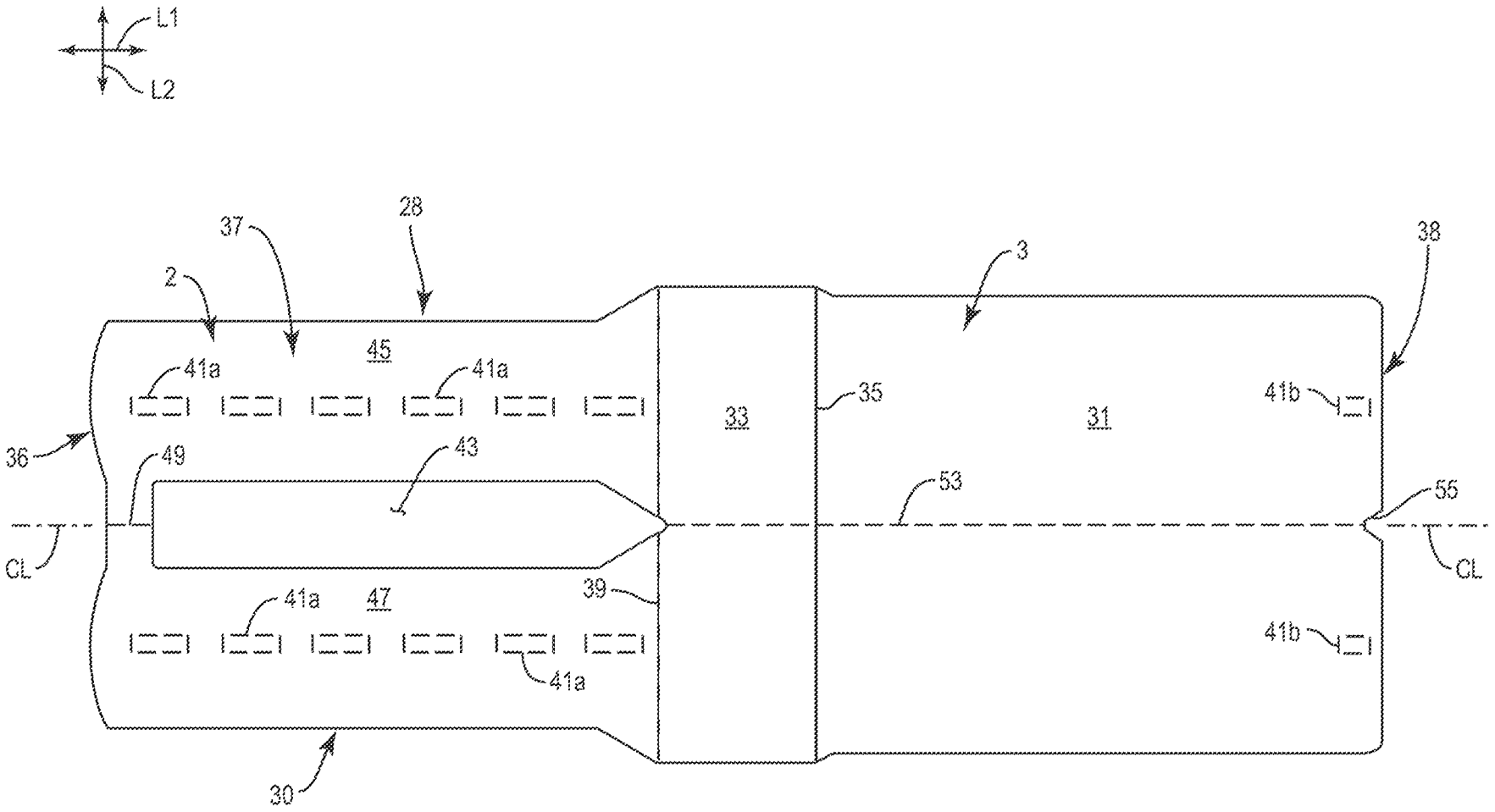
FIG. 1 is an exterior plan view of a construct blank used to form a shipping and dispensing construct according to an exemplary embodiment of the disclosure.

FIG. 1 is a plan view of an exterior surface 2 of a construct blank 3 used to form a shipping and dispensing construct 5 (FIGS. 3A and 3B) according to an exemplary embodiment of the disclosure. The construct 5 can be used to hold a plurality of product holding containers C securely in a package 75 for shipping from the product holding container supplier to a point-of-sale vendor (e.g., department store, grocery store, etc.) where the construct with attached product holding containers (e.g., the package 75) can be displayed for purchase by a consumer. In one embodiment, the package 75 has attachment features for securely attaching the product holding containers C to the construct 5 and dispensing features for allowing the respective product holding container C to be released or dispensed from the construct 5 (e.g., by the consumer).

Figure 2B:
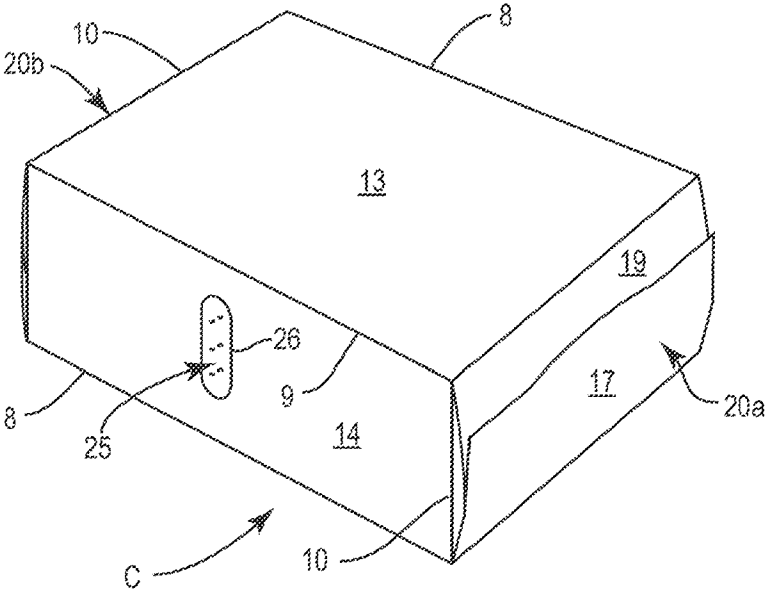
FIG. 2B is a perspective view of the product holding carton formed from the carton blank of FIG. 2A according to the exemplary embodiment of the disclosure.
Figure 2A:
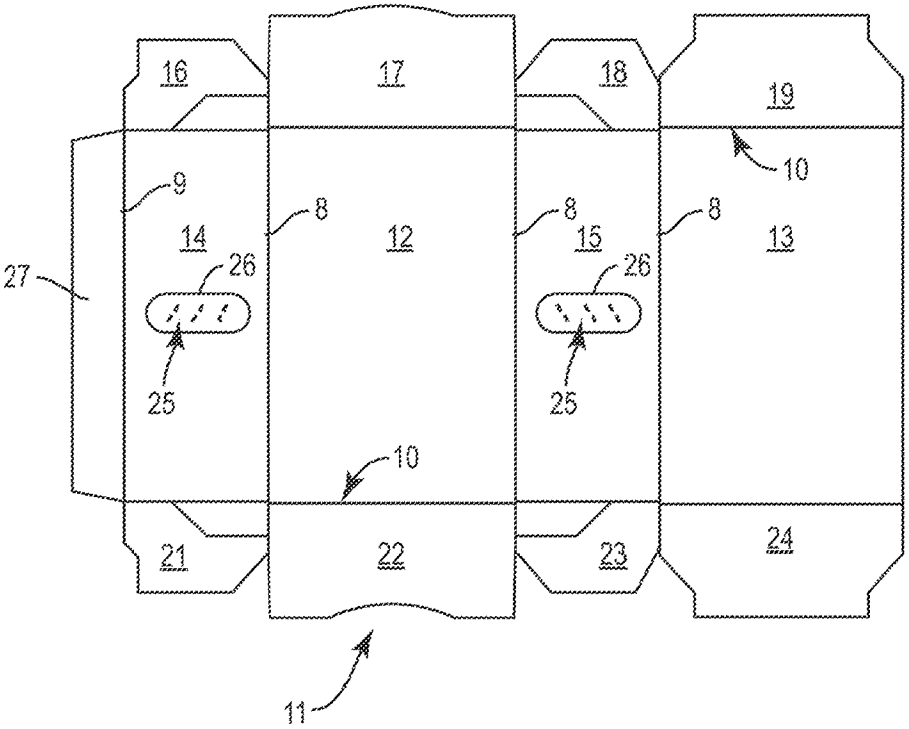
FIG. 2A is an exterior plan view of a carton blank used to form a product holding carton according to the exemplary embodiment of the disclosure.

In one embodiment, twelve product holding containers C are attached to the construct 5 and can be arranged in two rows of six containers (e.g., a first row R1 and a second row R2 as shown in FIGS. 3A-5), but more or less than twelve product holding containers can be contained in the construct and the containers can be arranged in other than two rows of six containers without departing from the disclosure. In the illustrated embodiment, the product holding containers C are illustrated as paperboard cartons C (FIG. 2B) formed by the carton blank 11 (FIG. 2A) that hold a consumer product (e.g., soap or other consumer product). The carton blank 11 has a top container panel 12, a bottom container panel 13, two side container panels 14, 15, and end flaps 16, 17, 18, 19 for closing a first end 20*a* of the carton C and second end flaps 21, 22, 23, 24 for closing a second end 20*b* of the carton. As shown in FIG. 2A, the panels 12, 13, 14, 15 are foldably connected along lateral fold lines 8 and an attachment flap 27 is foldably connected to the side panel 14 along a lateral fold line 9. In the illustrated embodiment, the end flaps 16, 17, 18, 19 and 21, 22, 23, 24 are foldably connected along respective marginal portions of the carton blank 11 along respective longitudinal fold lines 10.

In the illustrated embodiment, each of the side container panels 14, 15 has a glue assist area 25 formed by a partial cut 26 (e.g., a cut that extends partially through the thickness of the carton blank 11). In some embodiments, the partial cut 26 could be replaced by any suitable line of weakening (e.g., a tear line, a cut line interrupted by one or more nicks, one or more partial cuts in combination with one or more full cuts, etc.). As shown in FIGS. 2A and 2B, the partial cuts 26 extend around the respective glue assist areas 25. The glue assist areas 25 facilitate application of glue or other adhesive to the containers C so that the side panels 14, 15 of the containers can be attached to the shipping and dispensing construct 5. For example, the glue assist areas 25 can include cuts, partial cuts, or other features for facilitating adhering the container C with the glue (e.g., by increasing and/or improving the contact of the glue with the material of the container C). In the illustrated embodiment, the glue assist areas 25 and/or the partial cuts 26 form attachment features on the side container panels 14, 15 in the carton blank 11 and the container C for facilitating attachment of the containers C to the shipping and dispensing construct C and/or for facilitating separation of the containers C from the shipping and dispensing construct as described in more detail below. The glue assist areas 25 and/or the partial cuts 26 could be omitted or could be otherwise shaped, arranged, positioned, and/or configured without departing from the disclosure.

When the product holding container C is formed, the panels 12, 13, 14, 15 are folded along the lateral fold lines 8 to extend around a container interior and the attachment flap 27 is folded along the lateral fold line 9 and adhered to an interior surface of the bottom panel 13. A product can be inserted into the container interior and the ends 20*a*, 20*b* of the container C can be at least partially closed by folding the end flaps 16, 17, 18, 19 and 21, 22, 23, 24 along the longitudinal fold lines 10 and overlapping the end flaps. Alternatively shaped and/or configured product holding containers C may be held in the shipping and dispensing construct 5 without departing from the disclosure.

The construct blank 3 has a longitudinal axis L1 and a lateral axis L2 and a first longitudinal edge 28 and a second longitudinal edge 30. In the illustrated embodiment, the construct blank 3 has a front panel 31 foldably connected to a bottom panel 33 along a first lateral fold line 35 and a back panel 37 foldably connected to the bottom panel 33 along a second lateral fold line 39. In the illustrated embodiment, the shipping and dispensing construct blank 3 has lateral edges 36, 38.

In one embodiment, the back panel 37 has attachment features in the form of glue locations 41*a* that are for receiving glue or other suitable adhesive located on the glue assist area 25 of each container C to attach a respective container to the shipping and dispensing construct 5. In the illustrated embodiment, a first portion 45 of the back panel 37 includes six glue locations 41*a* and a second portion 47 of the back panel includes six glue locations 41*a*. In addition, glue locations 41*b* (e.g., two glue locations 41*b*) can be included in the front panel 31 (e.g., proximate to the lateral edge 38) where glue or other suitable adhesive can be located to attach the front panel 31 to glue assist areas 25 of the top container C in each row R1, R2. In the illustrated embodiment, the back panel 37 includes a central opening 43 between the first portion 45 of the back panel and the second portion 47 of the back panel. The central opening 43 extends from the lateral fold line 39 at one end and the back panel 37 includes a tear line 49 extending from an opposite end of the central opening 43 to the lateral edge 36 of the blank 3 (e.g., so that the first portion 45 and the second portion 47 of the back panel 37 are separable from one another along the tear line 49).

In the illustrated embodiment, dispenser features of the blank 3 include the tear line 49 (e.g., first tear line 49) and a tear line 53 (e.g., second tear line 53) that extends from the central opening 43 at the lateral fold line 39, across the bottom panel 33, and across the front panel 31 to a notch 55 in the lateral edge 38 of the blank 3. In one embodiment, tear line 49 in the back panel 37, the central opening 43 in the back panel, and the tear line 53 extending across the bottom panel 33 and the front panel 31 are aligned with the central longitudinal axis CL of the blank 3 (FIG. 1). In the illustrated embodiment, the central longitudinal axis CL divides the blank 3 into two portions that are mirror images of each other. In an exemplary embodiment, the first portion 45 of the back panel 37 is separable from the second portion 47 of the back panel along the tear line 49 and the opening 43 and portions of the bottom panel 33 and the front panel 31 are separable from one another along the tear line 53. The tear lines 49, 53 and the central opening 43 form dispensing features that allow separation of the two rows R1, R2 of the product holding containers C as described in more detail below. The blank 3 could have other features and the features of the blank could be otherwise shaped, arranged, and/or configured without departing from the disclosure.

Figure 3A:
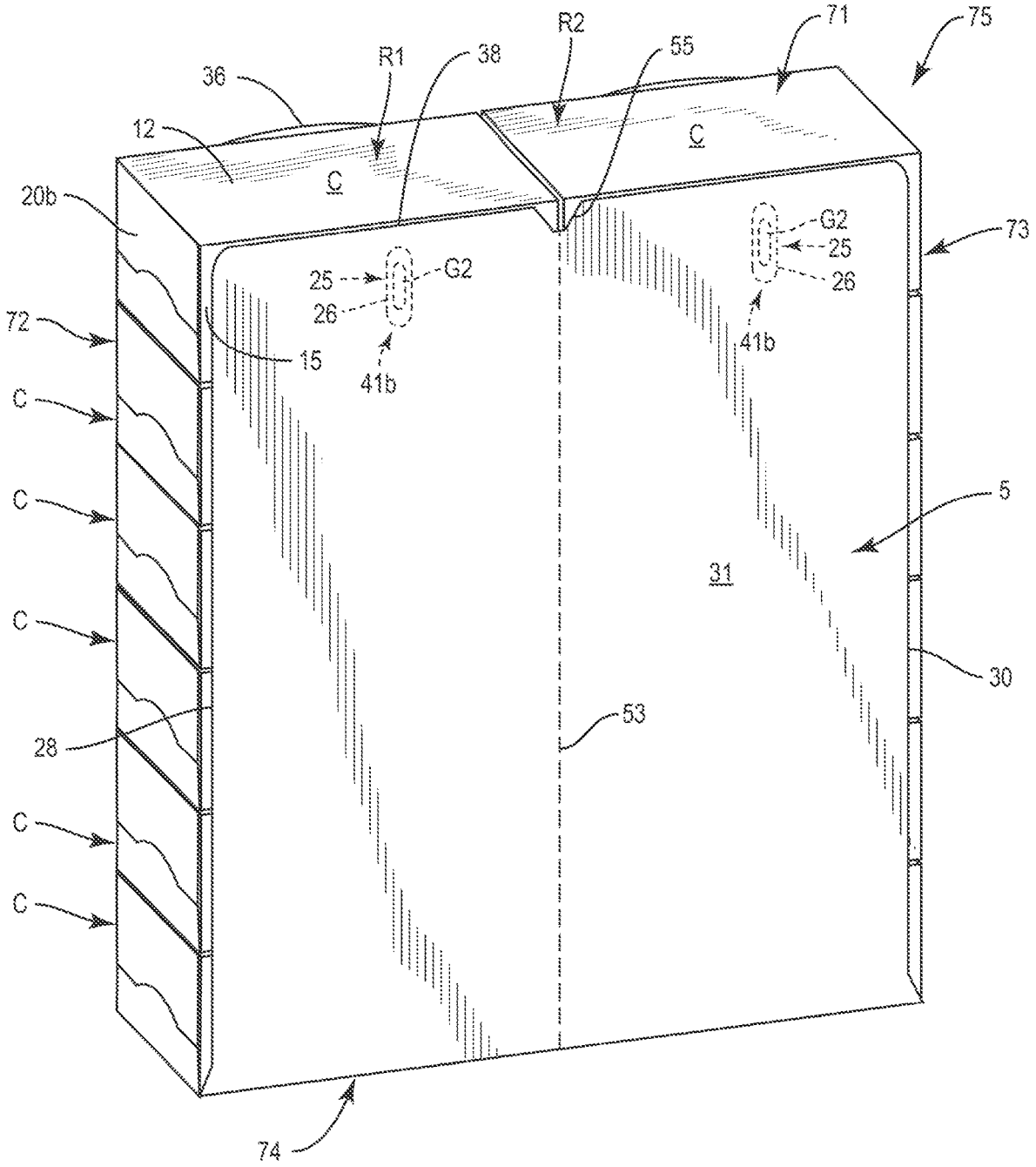
FIGS. 3A and 3B are perspective views of a package including the shipping and dispensing construct formed from the construct blank of FIG. 1 and a plurality of product holding containers of FIG. 2B according to the exemplary embodiment of the disclosure.
Figure 3B:
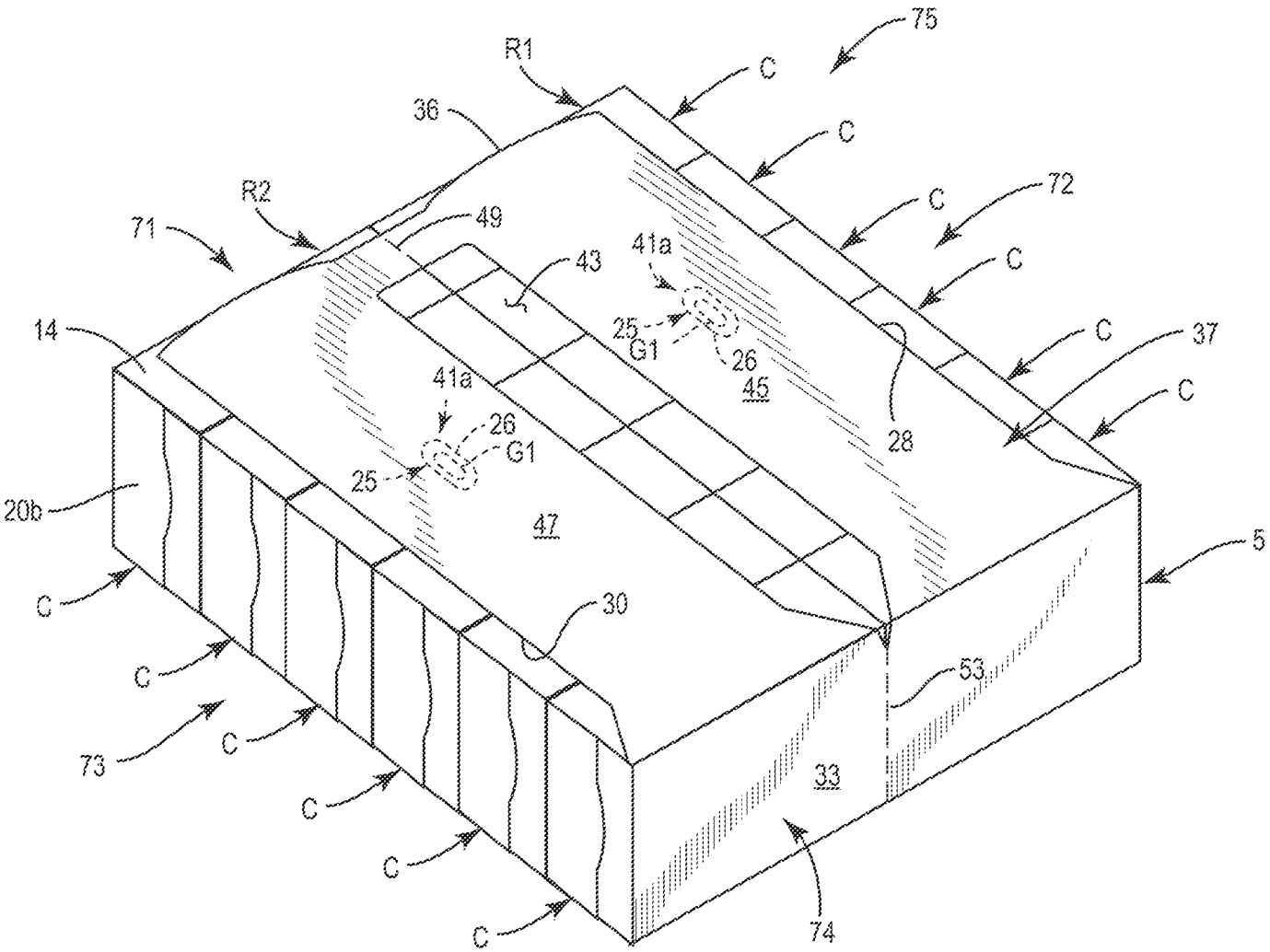

In one embodiment, the shipping and dispensing construct 5 can be formed from the construct blank 3 as shown in FIGS. 3A and 3B. The construct 5 is formed around the product holding containers C that are arranged in the two rows R1, R2 of six containers. The two rows R1, R2 of product holding containers C are placed on the bottom panel 33. Glue or other adhesive can be placed (e.g., in a bead or a dot with a timed gluing operation) on the glue assist areas 25 of the product holding container C and/or on the glue locations 41*a*, 41*b* of the back panel 37 and the front panel 31. In the illustrated embodiment, the glue G1, G2 (FIGS. 3A and 3B) is a releasable glue, such as fugitive glue, but the glue could be a permanent glue, or any other suitable adhesive without departing from the disclosure.

The front panel 31 is folded about the first lateral fold line 35 relative to the bottom panel 33 and into contact with the front of the two rows R1, R2 of product holding containers C. The back panel 37 is folded about the second lateral fold line 39 relative to the bottom panel 33 and into contact with the back of the two rows R1, R2 of product holding containers C. As schematically shown in FIGS. 3A and 3B with hidden lines for two of the containers C, the bead or dot of glue G2, G1 attaches the respective front panel 31 and back panel 37 to the respective glue assist areas 25 of the containers C at the respective glue locations 41*b*, 41*a*. In one embodiment, the partial cuts 26 can extend at least partially around the glue beads G1, G2 when the containers C are attached to the shipping and dispensing construct 5. Accordingly, the product holding containers C are attached to the back panel 37 of the shipping and dispensing construct 5, and the top two product holding containers C in the rows R1, R2 are attached to the front panel 31. As shown in the figures, only the top container C in each row R1, R2 is attached to the front panel 31 by beads of glue G2 at glue locations 41*b* (FIG. 3A); however, in other embodiments, any suitable number of the containers C could be attached to the front panel 31.

In this way, the shipping and dispensing construct 5 forms a sleeve around the two rows of product holding containers C having an open top end 71 at the top of the construct corresponding to the spaced apart lateral edges 36, 38 of the construct blank 3 (e.g., the first lateral edges 26, 38 extend along the open top end 71), open sides 72, 73 corresponding to the spaced apart longitudinal edges 28, 30 of the construct blank 3 (e.g., the first longitudinal edge 28 extends along the first open side 72 and the second longitudinal edge 30 extends along the second open side 73), and a closed bottom 74 comprising the bottom panel 33 that support the two rows R1, R2 of the product holding containers C. A package 75 of the present disclosure is formed by the shipping and dispensing construct 5 with the product holding containers C attached to the construct. The package 75 can be shipped to a point of sale vendor (e.g., department store, grocery store, etc.) for sale to a consumer. The package 75, shipping dispensing construct 5, and/or construct blank 3 can have other features and can be alternatively shaped, arranged, and/or configured without departing from the disclosure.

Figure 4:
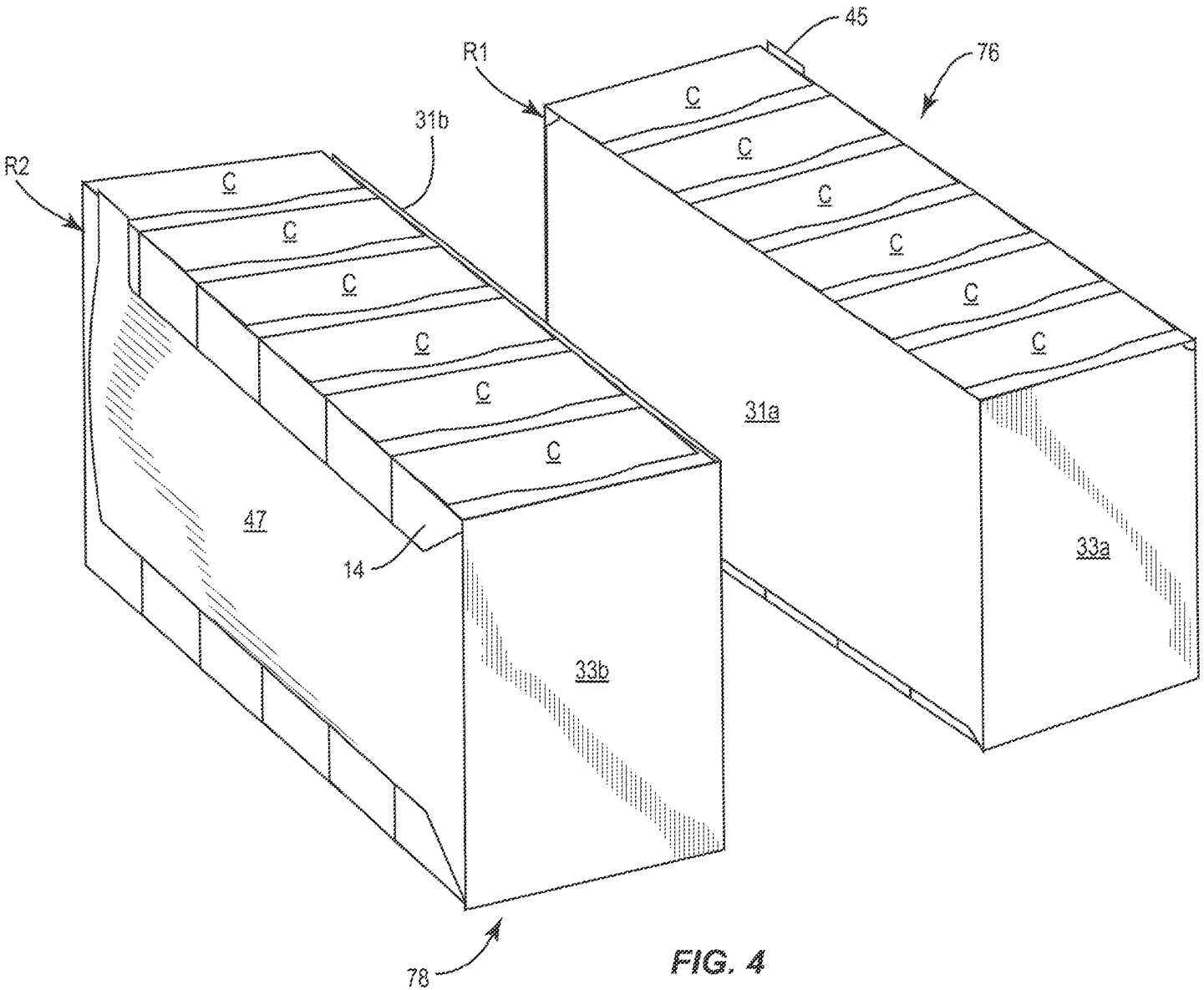
FIG. 4 is a perspective view of two dispensing portions formed from the package of FIGS. 3A and 3B according to the exemplary embodiment of the disclosure.

In one embodiment, the product holding containers C can be dispensed from the shipping and dispensing construct 5 of the package 75 by tearing along the tear lines 49, 53 to separate the package into two dispensing portions 76, 78 (e.g., at least a first dispensing portion 76 and a second dispensing portion 78) (FIG. 4). As shown in FIG. 4, each of the dispensing portions 76, 78 includes a respective one of the two rows R1, R2 of six product holding containers C, the respective portions 45, 47 of the back panel 37, respective portions 31*a*, 31*b* of the front panel 31, and respective portions 33*a*, 33*b* of the bottom panel 33. In one embodiment, the portions 45, 47 of the back panel 37 are separated along the tear line 49 and the portions 31*a*, 31*b*, 33*a*, 33*b* are formed when the back panel 31 and the bottom panel 33 are torn along the tear line 53.

Figure 5:
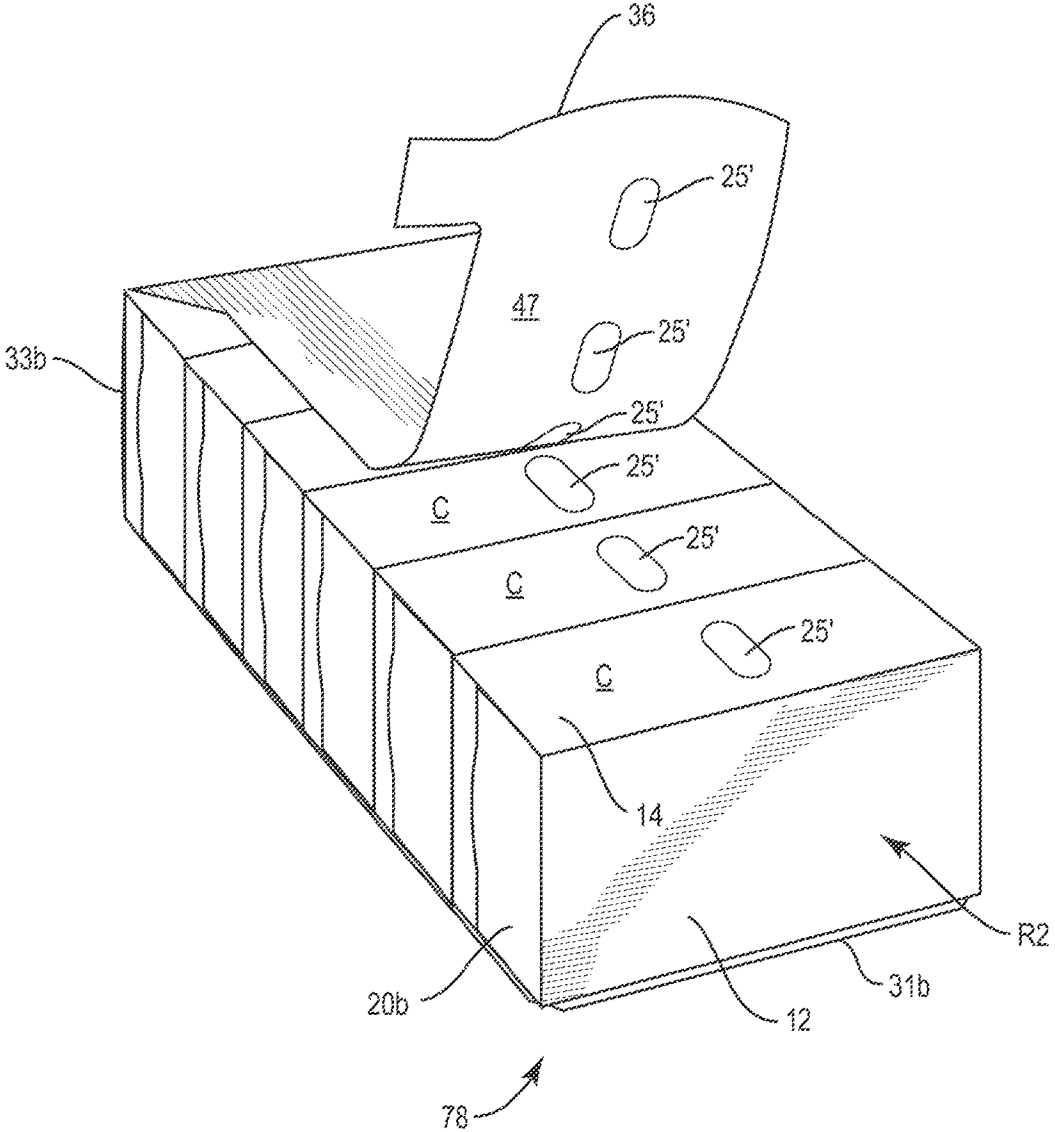
FIG. 5 is a perspective view of one the dispensing portions of FIG. 4 with a portion of the back panel separated from some of the containers according to the exemplary embodiment of the disclosure.

The product holding containers C can be released from the respective dispensing portion 76, 78 of the package 75 by grasping and lifting a respective edge of the portions 45, 47 of the back panel corresponding to the lateral edge 36 of the blank 3. For example, as shown in FIG. 5, the portion 47 of the back panel 37 in the dispensing portion 78 can be pulled away from the containers C to separate the portion 47 from the containers C. In one embodiment, as the portion 47 is pulled away, the glue G1 can release the attachment between the portion 47 and the glue assist areas 25 of the containers C (e.g., if a releasable glue is used) and/or the attachment features of the containers C can at least partially separate (e.g., tear away) from the containers C (e.g., along the partial cuts 26) to release the containers C from the portion 47. Similarly, any of the containers C (e.g., the top container C) that is attached to the front panel 31 can be released from the front panel portion 31*b* by pulling the container away from the front panel portion 31*b* to release the glue G2 and/or to at least partially separate (e.g., tear away) the attachment feature of the container C along the partial cut 26. In an exemplary embodiment, the glue assist areas 25 of the containers C can at least partially separate at the partial cuts 26 so that attachment portions 25' of the glue assist areas 25 can remain in the containers C and remain attached to the portion 47 of the back panel 37 when the portion 47 is pulled away from the containers C (FIG. 5). The releasable glue G1, G2 between the containers C and/or the partial cuts 26 of the attachment features on the containers C and/or the glue locations 41*a*, 41*b* of the portions 45, 47 of the back panel 37 and/or the front panel portions 31*a*, 31*b* can allow the container to be separated from the dispending portions 76, 78 so that one or more of the containers C can be dispensed from a respective dispensing portion. The dispensing portion 76, 78 could be otherwise shaped, arranged, and/or configured without departing from the disclosure.

The package 75 and shipping and dispensing construct 5 could have other dispensing features or the dispensing features could be otherwise shaped, arranged, and/or configured without departing from the disclosure.

In an exemplary embodiment, the package 75 of the present disclosure has a shipping and dispensing construct 5 comprising paperboard material that is attached to the product holding containers C and eliminates or reduces the use of plastic over wrap around the product holding containers. The front panel 31 provides a suitable surface for graphics such as advertising or other indicia. The shipping and dispensing construct 5 has dispensing features to allow separation of the package 75 into two dispensing portions 76, 78 and subsequent removal of the individual product holding containers C from the dispensing portions.

In general, the blanks of the present disclosure may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A package comprising:

a shipping and dispensing construct comprising a plurality of panels extending at least partially around an interior of the construct and dispensing features in one or more panels of the plurality of panels;

a plurality of product holding containers, each product holding container of the plurality of product holding containers comprising at least a container panel and an attachment feature extending in at least the container panel, the attachment feature comprising a partial cut extending in at least the container panel, the product holding containers being attached to the shipping and dispensing construct at the respective attachment features, wherein the dispensing features facilitate removing the product holding containers of the plurality of product holding containers from the package.

2. The package of claim 1, wherein the dispensing features comprise a tear line for at least partially separating the package into a first dispensing portion and second dispensing portion, and each of the first dispensing portion and the second dispensing portion is for holding product holding containers of the plurality of product holding containers.

3. The package of claim 1, wherein the dispensing features comprise a first tear line extending in at least the back panel and a second tear line extending in at least the bottom panel and the front panel.

4. The package of claim 3, wherein a central opening extends in the back panel between a first portion of the back panel and a second portion of the back panel, the first portion and the second portion being separable from one another along the first tear line.

5. The package of claim 4, wherein the first portion is attached to a first row of the plurality of product holding containers and the second portion is attached to a second row of the product holding containers.

6. The package of claim 1, further comprising an open top end opposite to the bottom panel, wherein respective edges of the front panel and the back panel extend along the open top end.

7. The package of claim 1, wherein the plurality of panels extends at least partially around an interior of the shipping and dispensing construct, the plurality of panels comprises a first edge extending along a first open side of the shipping and dispensing construct, and the plurality of panels comprises a second edge extending along a second open side of the shipping and dispensing construct.

8. The package of claim 7, wherein respective edges of the front panel and the back panel extend along an open top end of the shipping and dispensing construct.

9. The package of claim 1, wherein each of the product holding containers comprises a plurality of container panels, and, for each product holding container, the attachment feature extends in one or more container panels of the plurality of container panels.

10. The package of claim 1, wherein each of the attachment features comprises a glue assist area that is formed in the container panel and that facilitates the attachment of the respective product holding containers to the shipping and dispensing construct with glue.

11. The package of claim 10, wherein, for each of the attachment features, the partial cut extends at least partially around the glue assist area for facilitating separation of the respective product holding containers from the shipping and dispensing construct when removing the respective product holding containers from the package.

12. The package of claim 1, wherein the product holding containers are attached to the shipping and dispensing construct by respective beads of glue, and, for each of the attachment features, the partial cut extends at least partially around the respective beads of glue for facilitating separation of the respective product holding containers from the shipping and dispensing construct when removing the respective product holding containers from the package.

13. The package of claim 1, wherein, for each of the product holding containers, the container panel is a first side container panel and the partial cut is a first partial cut, wherein each of the product holding containers further comprises a second side container panel and, for each of the product holding containers, the attachment features comprise a second partial cut in the second side container panel.

14. The package of claim 1, wherein the product holding containers are arranged in a first row and a second row, the dispensing features comprise a tear line for at least partially separating the shipping and dispensing construct into a first dispensing portion and second dispensing portion so that the product holding containers in the first row are attached to the first dispensing portion and the product holding containers in the second row are attached to the second dispensing portion.

15. A method comprising:

obtaining a construct blank comprising a plurality of panels comprising a front panel, a bottom panel, and a back panel and dispensing features in one or more panels of the plurality of panels;

obtaining a plurality of product holding containers, each product holding container of the plurality of product holding containers comprising at least a container panel and an attachment feature extending in at least the container panel, the attachment feature comprising a partial cut extending in at least the container panel;

attaching one or more panels of the plurality of panels to the attachment features of the plurality of product holding containers;

forming the construct blank into a shipping and dispensing construct, wherein the dispensing features facilitate removing the product holding containers of the plurality of product holding containers from the shipping and dispensing construct.

16. The method of claim 15, wherein the dispensing features comprise a tear line for at least partially separating the shipping and dispensing construct into a first dispensing portion and second dispensing portion, and each of the first dispensing portion and the second dispensing portion is for holding product holding containers of the plurality of product holding containers.

17. The method of claim 15, wherein the attaching the one or more panels of the plurality of panels to the attachment features of the plurality of product holding containers comprises arranging the product holding containers in a first row and a second row, the dispensing features comprise a tear line for at least partially separating the shipping and dispensing construct into a first dispensing portion and second dispensing portion so that the product holding containers in the first row are attached to the first dispensing portion and the product holding containers in the second row are attached to the second dispensing portion.

18. The method of claim 15, wherein each of the product holding containers comprises a plurality of container panels, and, for each product holding container, the attachment feature extends in one or more container panels of the plurality of container panels.

19. The method of claim 15, wherein each of the attachment features comprises a glue assist area formed in the container panel, the attaching the one or more panels of the plurality of panels to the attachment features of the plurality of product holding containers comprises attaching the one or more panels of the plurality of panels to the glue assist areas of the plurality of product holding containers with glue, and the glue assist areas facilitate the attachment of the respective product holding containers to the shipping and dispensing construct with the glue.

20. The method of claim 15, wherein the attaching the one or more panels of the plurality of panels to the attachment features of the plurality of product holding containers comprises attaching the one or more panels of the plurality of panels to the respective attachment features of the plurality of product holding containers with respective beads of glue, and the partial cuts of the attachment features of the product holding containers extend at least partially around the respective beads of glue for facilitating separation of the respective product holding containers from the shipping and dispensing construct.

* * * * *